US006026618A

United States Patent [19]

Locke et al.

[11] Patent Number: 6,026,618

[45] Date of Patent: Feb. 22, 2000

[54] MASONRY REINFORCEMENT SYSTEM

[75] Inventors: Reginald A. J. Locke, 915 Douglass St., San Francisco, Calif. 94114; Kenyon Barnes, Castro Valley, Calif.

[73] Assignee: Reginald A. J. Locke, San Francisco, Calif.

[21] Appl. No.: 08/959,678

[22] Filed: Oct. 29, 1997

[51] Int. Cl.[7] ..... E04C 5/08

[52] U.S. Cl. ..... 52/223.14; 52/223.7; 52/79.11; 52/79.12; 52/79.13; 52/167.1; 403/147; 403/195; 403/368

[58] Field of Search ..... 52/79.13, 79.11, 52/79.12, 167.3, 167.1, 223.6, 223.7, 223.14, 169.9; 403/147, 195, 368, 334

[56] References Cited

U.S. PATENT DOCUMENTS

| | | | |
|---|---|---|---|
| 3,579,758 | 5/1971 | Regan | 52/223.13 |
| 3,782,061 | 1/1974 | Minutoli et al. . | |
| 3,999,355 | 12/1976 | Stucky . | |
| 4,161,089 | 7/1979 | Omansky . | |
| 4,563,852 | 1/1986 | Achtenberg et al. . | |
| 4,694,621 | 9/1987 | Locke | 52/79.13 |
| 4,706,428 | 11/1987 | McCoy et al. . | |
| 4,718,209 | 1/1988 | Hansen et al. | 52/223.13 |
| 4,919,122 | 4/1990 | Kohlenbrenner | 52/223.7 |
| 5,015,128 | 5/1991 | Ross, Jr. et al. . | |
| 5,138,808 | 8/1992 | Bengtson et al. . | |
| 5,197,245 | 3/1993 | Davis . | |
| 5,497,841 | 3/1996 | Cox et al. . | |
| 5,630,301 | 5/1997 | Sieg | 52/223.14 X |

FOREIGN PATENT DOCUMENTS

| | | |
|---|---|---|
| 0 378 523 B1 | 3/1993 | European Pat. Off. . |
| 1455379 | 9/1966 | France . |
| 2635550 | 8/1988 | France . |

*Primary Examiner*—Christopher T. Kent
*Assistant Examiner*—Yvonne Horton-Richardson
*Attorney, Agent, or Firm*—Knobbe, Martens, Olson & Bear LLP

[57] ABSTRACT

A masonry reinforcement system includes a number of tensioning rods extending from the top to the bottom of a masonry wall structure in spaced columns. In each column, several rod segments are interconnected at each floor diaphragm using a double conical connector assembly. In portions of the wall structure where rod columns cannot be placed, such as window regions, spring tensioning assemblies are installed using a similar double conical connector assembly. Each type of connector assembly is embedded in a pocket formed in the masonry wall structure using a hardenable grout. After installation, the rods are post-tensioned to provide a compressive axial load to the masonry wall structure. The spring tensioner assemblies are tensioned prior to applying the grout to the void in the wall. For deteriorated masonry walls, reinforcing members are installed in bore holes formed in the mortar using a hard epoxy bonding agent and a finishing mortar layer so that the reinforcing members blend into the appearance of the masonry wall structure.

35 Claims, 8 Drawing Sheets

FIG. 3

MASONRY REINFORCEMENT SYSTEM

BACKGROUND OF THE INVENTION

This invention relates to masonry structures in general, and more particularly to a technique for reinforcing existing masonry structures to provide greater structural strength and resistance to externally applied forces.

Known masonry structures typically comprise a series of rows of individual masonry elements, such as cement blocks, bricks and the like, adhered together using cementitious mortar or some other adhesive material. Both the mortar and the masonry elements exhibit inferior response to shear forces imposed on a masonry structure by external forces, such as winds and earthquakes, when compared to steel reinforced building structures. In addition, over time, the mortar deteriorates due to weathering, aging and other factors. As a result, the mortar loses adhesive strength, becomes soft and friable, thereby weakening the adhesive bond between the individual masonry elements. This further impairs the ability of such structures to withstand externally applied forces.

While efforts have been made in the past to reinforce existing mortar and masonry structures by using steel members, such as rods or beams, as part of a retrofitting operation, such efforts have been found to be either unreasonably expensive, incapable of retrofitting installation, incompatible with existing structures, relatively ineffective or a combination of these factors.

U.S. Pat. No. 4,694,621 for "Modular Building Constructing Means" issued Sep. 22, 1987, discloses a system for constructing modular metal buildings using a unique conical connector and fastening rods for connecting together the structural modules of a steel building. The unique conical connector is used in conjunction with a socket assembly rigidly secured to the building and a vertically oriented tensioning mechanism which passes through a bore in the connector in order to enable compressive/tensile force to be created in the vertical direction. A series of connectors, sockets and tensioning mechanisms are arranged in a vertical column from the foundation to the top of the building, and a plurality of such series of elements is provided in parallel columns distributed about and through the building. The system disclosed and claimed in the '621 patent, while effective, was designed expressly for use in steel building construction. The disclosure of U.S. Pat. No. 4,694,621 is hereby incorporated by reference.

SUMMARY OF THE INVENTION

The invention comprises a method, structure and apparatus for providing an improved masonry structure which is relatively inexpensive to install, compatible with both new and existing structures, highly effective in strengthening a masonry structure and employs some of the principles and elements of the '621 system modified and adapted to the specific requirements of masonry structures.

From a process standpoint, the invention comprises a method of providing a masonry structure with improved response to externally applied forces, the method including the steps of forming internal holes in the masonry walls from the top of a given wall to the foundation, installing a plurality of tensioning rod connector assemblies in the holes, with the bottom of each tensioning rod connector assembly anchored to the foundation, and post-tensioning the rods at the roof so that each rod connector assembly applies an axial load in compression to the wall in order to improve strength, performance and durability of the structure. In areas of the wall in which it is impossible or impractical to install a tension rod connector assembly, such as in window areas of a wall, additional spring-tension connector assemblies are installed to provide continuity at the floor diaphragm.

The holes are formed in the masonry walls using wet or dry core drilling techniques and procedures are followed for controlling and collecting the dust and debris caused by the core drilling to minimize environmental contamination. After formation of the holes, the holes are cleaned of residual dust and debris.

Both the tensioning rod connector assemblies and the spring-tension connector assemblies are installed by coupling a first portion of each connector assembly to the associated floor and coupling a second portion to the adjacent wall structure. Each type of connector assembly is also preferably installed by forming a void in the masonry wall structure at each desired location, installing a lower portion of the connector assembly in the void, filling a lower portion of each void with a hardenable liquid and permitting the liquid to harden, isolating the hardened liquid from the upper portion of each void, installing the remaining connector components, filling the upper portion of each void with a hardenable liquid and permitting the liquid to harden.

For masonry wall structures having a plurality of floors, the tensioning rod connector assemblies are installed progressively from the lowermost floor to the uppermost floor.

From a system standpoint, the invention comprises a system for reinforcing a masonry wall structure having a top, a bottom, and at least one floor intermediate the top and bottom, the system including a plurality of bores formed in the masonry wall structure between the top and bottom of the masonry wall structure; a plurality of series-connected post-tension rods and force transmission connectors located in each of the bores with the force transmission connectors located at the level of the at least one floor. The force transmission connectors each include a first portion coupled to the associated floor and a second portion coupled to the adjacent masonry wall structure. A plurality of spring-tension connectors are located in regions of the wall structure between the bores at the level of the at least one floor. Each spring-tension connector includes a first portion coupled to the associated floor, a second portion coupled to the adjacent masonry wall structure, and a tensioned spring coupled between the first and second portions to dampen relative motion therebetween.

A plurality of voids are formed in the masonry wall structure at the location of each of the plurality of force transmission connectors and spring-tension connectors. Each void contains an associated one of the connectors and has a first mass of hardened material in a lower void portion, a second mass of hardened material in an upper void portion, and a void separator located between the first and second masses.

The first and second portions of each of the connectors preferably includes a tapered wall portion, and each connector also preferably includes a connector member having a pair of tapered wall sections each received in a different one of the tapered wall portions of the first and second connector portions and a central through-bore for slidably receiving an associated one of the rods. At least one of the tapered wall portions is preferably coated with a low friction material.

The first and second portions of each spring-tension connector likewise includes a tapered wall portion, and each spring-tension connector also preferably includes a connector member having a pair of tapered wall sections each received in a different one of the tapered wall portions of the first and second portions of the spring-tension connector and a central through-bore. In addition, a fastener is received within the central through-bore for coupling the tension spring means between the first and second connector portions.

From an additional process standpoint applicable to structures with deteriorated mortar, the invention comprises a method of providing a reinforced masonry structure having individual masonry elements adhered together by an adhesive material, the method including the steps of removing the interstitial adhesive material between at least some masonry elements to a desired depth in order to form voids, forming bore holes in the adhesive material remaining in the voids at a desired spacing and to a desired depth, inserting an adhesive substance, preferably epoxy adhesive, into the bore holes, providing a plurality of reinforcing members each having a body portion and at least one leg portion extending away from the body portion, installing the reinforcing members into the voids by inserting the leg portions into the bore holes with the body portion of adjacent reinforcing members in mutual contact, inserting an adhesive substance, preferably epoxy resin, into the voids to cover the reinforcing members, and allowing the adhesive substances to harden so that the reinforcing members are secured to the masonry elements and to each other.

The body portions of the reinforcing members preferably terminate at one end in an offset end section, and the step of installing the reinforcing members into the voids preferably includes the steps of aligning the offset end section of each reinforcing member with the end of the adjacent reinforcing member in order to form a lap joint.

The method also preferably includes the additional step of applying a finishing adhesive coat over the adhesive substance in the voids in order to match the original color and texture of the adhesive material to retain the original visual appearance of the masonry structure.

From an additional combination standpoint, the invention comprises a reinforced masonry wall structure having a plurality of masonry elements adhered together in row and column fashion by an adhesive material, usually mortar, a plurality of spaced bore holes formed in the mortar to a desired depth, a plurality of reinforcing members each having a body portion and at least one leg portion extending away from the body portion, the leg portions of each reinforcing member being received within an associated bore hole, a first adhesive substance received in the bore holes, adjacent ones of the plurality of reinforcing members being in mutual contact, and a second adhesive substance formed over the plurality of reinforcing members to bond the reinforcing members to the masonry elements and to each other. The first and second adhesive substances are preferably epoxy adhesives.

The body portion of each of the plurality of reinforcing members preferably has an offset end section and a second end section, and the offset end section of each reinforcing member is preferably aligned with the second end section of an adjacent reinforcing member to form a lap joint. The reinforcing members are preferably fabricated from metal wire.

Each reinforcing member preferably has a plurality of pairs of leg portions spaced along the body portion, each pair comprising a U-shaped segment secured to the body portion.

From an additional component standpoint, the invention comprises a reinforcing member for use in forming a reinforced masonry structure with a plurality of masonry elements adhered together by an adhesive material, the reinforcing member comprising an elongate body having a longitudinal axis and at least one leg portion extending away from the longitudinal axis and adapted to be received within bore holes formed in the adhesive material and bonded therein by means of an adhesive substance. The elongate body terminates in a first end section adapted to engage the end of an adjacent reinforcing member when installed in the masonry structure in order to provide mutual contact therebetween.

The first end section of the reinforcing member is preferably offset from the longitudinal axis so that a lap joint is formed between the first end section and the end of an adjacent reinforcing member during installation.

The reinforcing member preferably has a plurality of pairs of leg portions spaced along the elongate body, with each pair comprising a U-shaped segment joined to the elongate body.

Each member is preferably fabricated from metal wire, notably steel, and each U-shaped segment is preferably joined to the elongate body by welding.

For a fuller understanding of the nature and advantages of the invention, reference should be made to the ensuing detailed description taken in conjunction with the accompanying drawings.

DETAILED DESCRIPTION OF THE PREFERRED EMBODIMENTS

Figure 1:
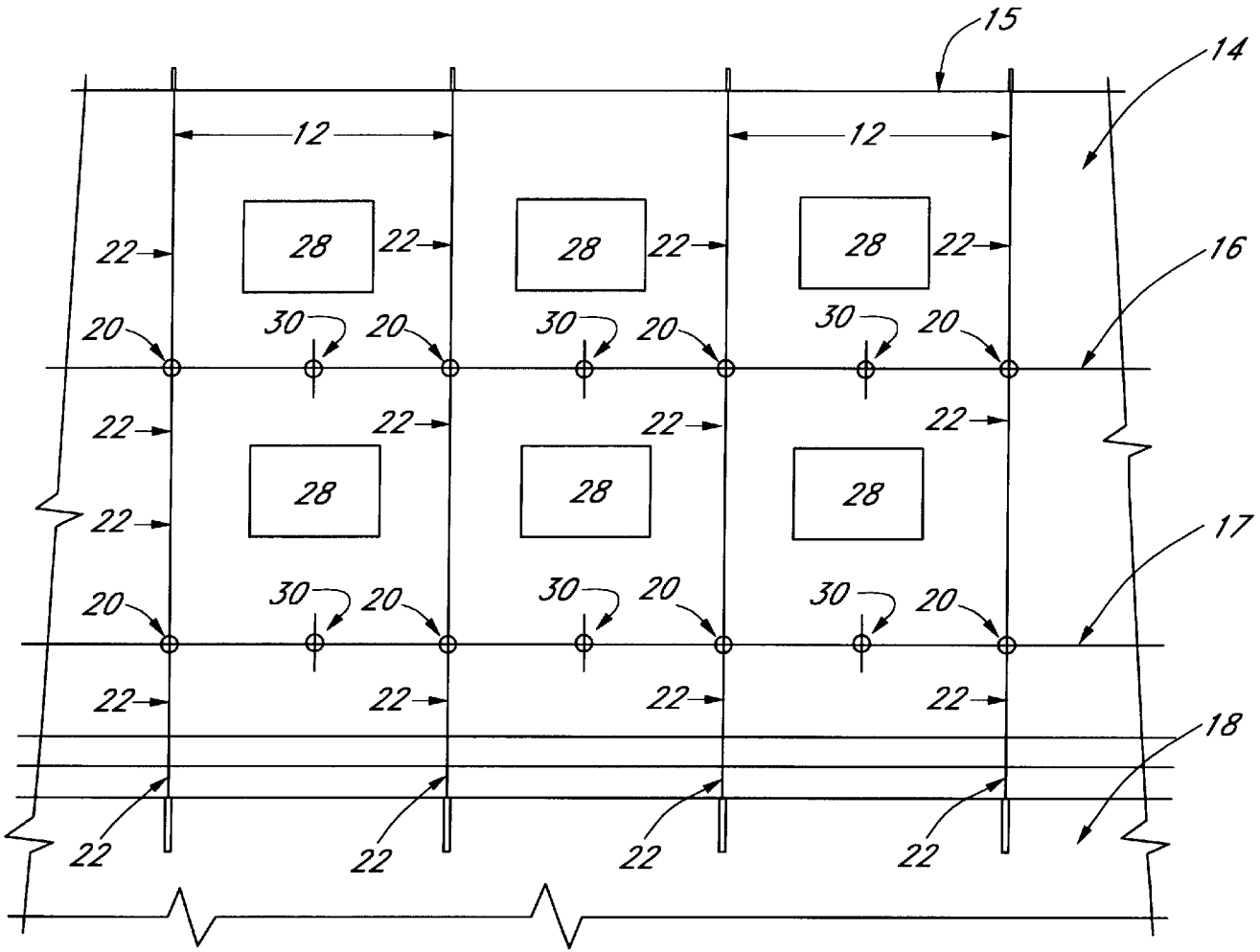
FIG. 1 is a schematic elevational view of a masonry wall structure illustrating the placement of the connectors and rods in a masonry wall structure according to the invention.

Turning now to the drawings, FIG. 1 is schematic elevational view of one wall of a masonry structure illustrating the masonry reinforcement system according to the invention. As seen in this figure, a plurality of vertical tensioning columns 12 is installed in a masonry wall 14, with each column 12 extending from the roof parapet 15 through the individual floors 16, 17 to the foundation 18 of the building structure.

Each column 12 includes a plurality of MODULOC™ connectors 20 of the type shown in the '621 patent and tensioning rod sections 22 described more fully below which are interconnected in a given column 12 in such a manner as to provide a compressive force between the roof parapet 15 and the foundation 18. The columns 12 are installed in an existing masonry wall in a manner described more fully below using either dry or wet core drilling techniques, which are conducted from the roof of the building.

In those locations in which the installation of a vertical column 12 is not possible, such as areas of the wall containing windows 28 or other obstructions, a modified MODULOC™ connector assembly 30, which is described more fully below, is installed. The modified MODULOC™ connectors 30 provide a localized vertical tensioning force between the adjacent floor and the masonry wall region at which the connector 30 is located.

Figure 2:
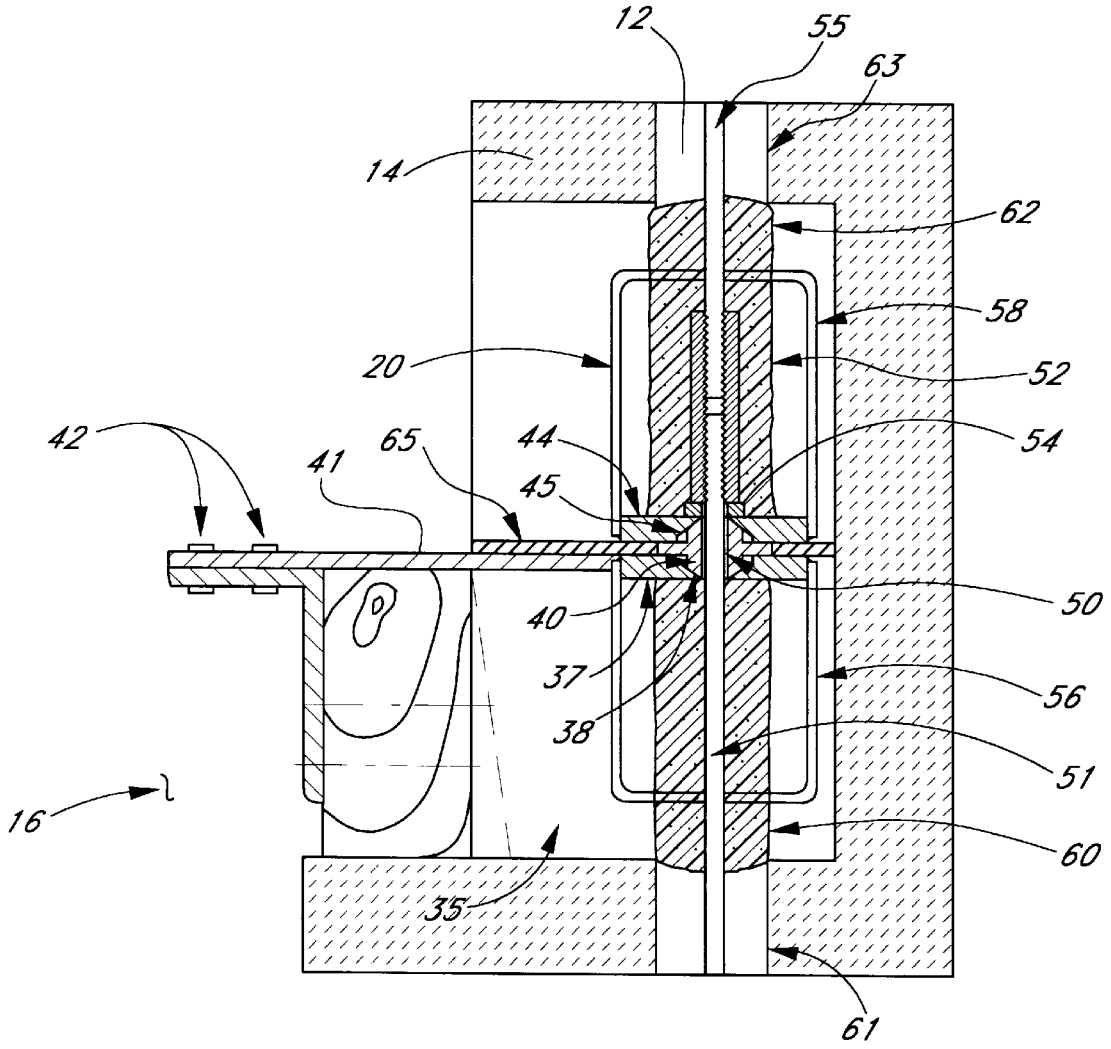
FIG. 2 is an elevational sectional view of one of the force transmission connectors and a portion of the rods according to the invention.

FIG. 2 is a sectional view of a single MODULOC™ connector assembly 20 forming part of a vertical column 12. As seen in this figure, assembly 20 is mounted within a void 35 formed in wall structure 14. Void 35 may be formed in any suitable fashion, such as by removing individual masonry blocks, or removing a portion of a single block. Connector assembly 20 includes a lower bearing plate 37 having a tapered surface 38 for receiving the tapered outer lower surface of a double conical connector member 40. Bearing plate 37 has a laterally extending flange 41 which is secured to the floor 16 by means of suitable fasteners, such as a pair of high strength bolts 42. Connector assembly 20 includes an upper bearing plate 44 having a tapered surface 45 for receiving the upper sloping surface of connector member 40. In addition, bearing plates 37 and 44 have extensions 56 and 58 for facilitating mechanical connection to the masonry wall through embedment in grout pockets described below. Extensions 56, 58 are preferably steel webs or straps which are secured at the ends to the respective one of bearing plates 37, 44, e.g. by welding. In the preferred embodiment, two such straps are used in parallel spaced arrangement for each bearing plate 37, 44. One or more of tapered surfaces 38, 45 and the unnumbered tapered surfaces of connector member 40 may be coated with a low friction material, such as TEFLON™, to lower the frictional forces between surfaces.

Passing through a central aperture 50 formed in connector member 40 is a tensioning rod 51, the upper end of which is threaded into a coupler nut 52. Tensioning rod 51 has a lower end (not shown) which is connected either to the upper end of a coupler nut 52 positioned at the next lower assembly 20 or anchored to the foundation 18 in any suitable fashion. A bearing washer 54 is interposed between the lower surface of coupler nut 52 and the upper surfaces of bearing plate 44 and connector member 40. During installation of connector assembly 20, hard setting grout is installed in void 35. The first or lower grout portion is installed after the lower bearing plate 37 is positioned within void 35; while the second or upper portion is installed after coupler nut 52 has been attached to rods 51, 55. A pair of foam sleeves 60, 62 are installed at bore holes 61, 63 formed in masonry wall 14 to allow lateral movement of rods 51, 55 without interference from the grout. A grout pocket separator 65 is positioned above flange 41 and functions to separate the grout in void 35 into two portions; a lower portion and an upper portion. This is necessary so that the lower and upper bearing plates 37, 44 are free to respond independently to motion of the floor diaphragm and wall 14, respectively, without interference from the grout.

Figure 3:
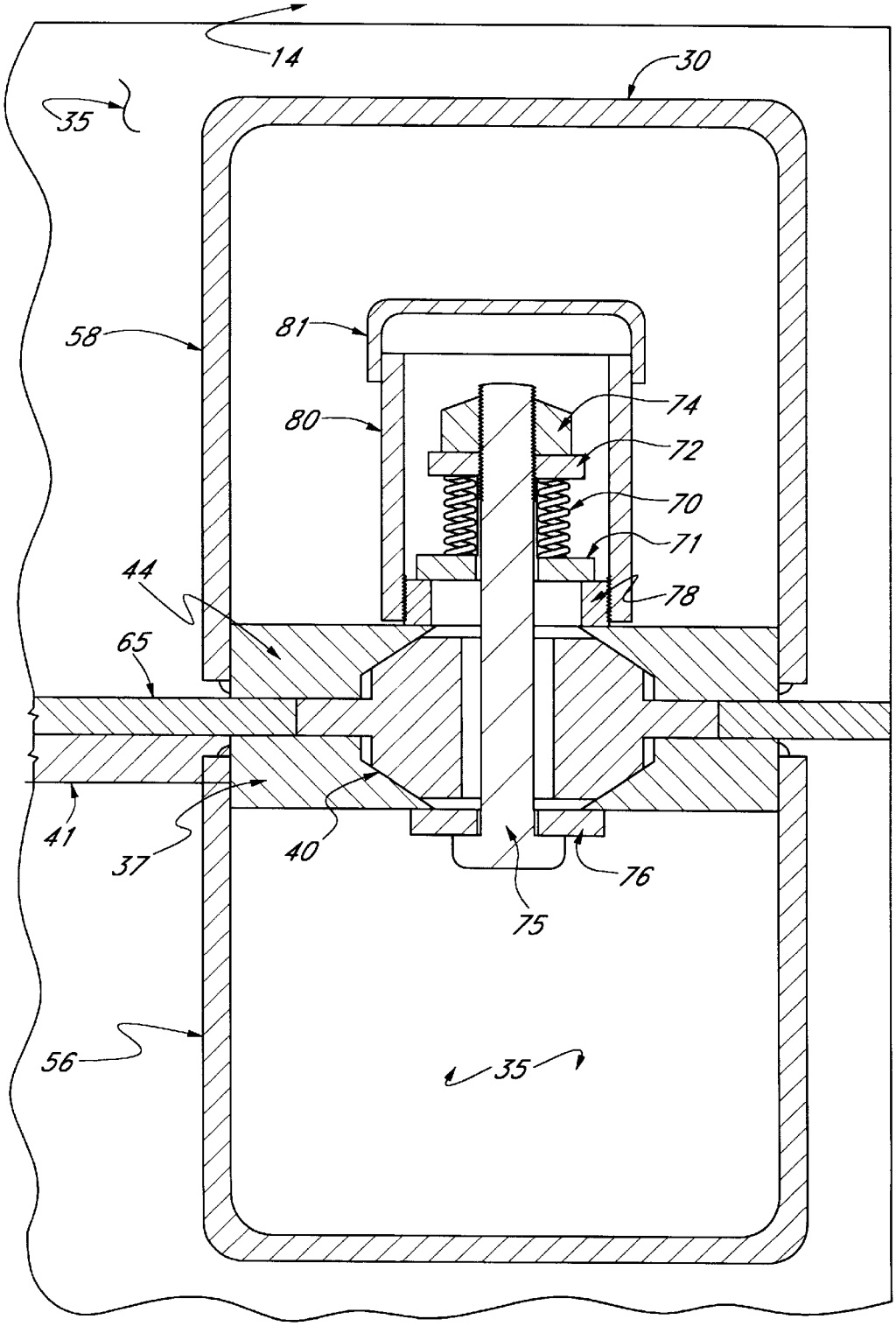
FIG. 3 is an elevational sectional view illustrating a spring-tension connector according to the invention.

FIG. 3 illustrates a connector assembly 30 which is employed in those regions of masonry wall 14 in which it is not possible to provide a vertical column of connector assemblies and rods. As seen in this figure, connector assembly 30 employs the same lower and upper bearing plates 37, 44 and connector member 40, as well as extensions 56, 58 for embedment in the grout pocket 35. Unlike the assembly 20, however, there are no tensioning rods or coupler nut. Instead, a tensioned spring assembly is used to provide lateral resistance to shear forces at the wall to floor intersection and functions to absorb or dampen externally applied forces of this type. The spring assembly includes a spring 70, preferably comprised of a plurality of stacked Belleville spring washers having a preselected stiffness, typically in the range from about 5–40 KIPS. Spring 70 is captured between a bearing washer 71 and an upper washer 72, the latter being held in place by a nut 74 threaded onto one end of a high strength bolt 75. Bolt 75 is passed upwardly through the central passageway formed in connector member 40, and a bearing washer 76 is provided between the head of bolt 75 and the lower surface of lower bearing plate 37. Bearing washer 71 rests on the upper surface of an externally threaded nipple 78 secured to the upper surface of upper bearing plate 44 in any suitable fashion, such as by welding. A cover assembly comprising a tubular sleeve 80 and an end cap 81 is installed over the spring assembly. In the preferred embodiment, the lower internal wall of sleeve 80 is threaded onto nipple 78 and cap 81 is press-fitted onto the upper end of sleeve 80.

The tension of spring 70 is adjusted by adjusting the vertical position of nut 74 on bolt 75. Connector assembly 30 is installed in masonry wall 14 in a manner essentially identical to that described above with reference to connector assembly 20, with the exception that the tensioning rods and coupler nut are absent.

As noted above, the connector columns 12 are installed using core drilling techniques known in the drilling industry, but modified in accordance with the requirements of the invention. In general, there are two basic core drilling techniques: wet and dry. Although wet core drilling is typically easier and more efficient to employ, dry core drilling techniques are more frequently employed with the invention for environmental reasons (e.g. it is typically easier to control drilling dust and debris employing a dry core drilling technique).

Figure 4:
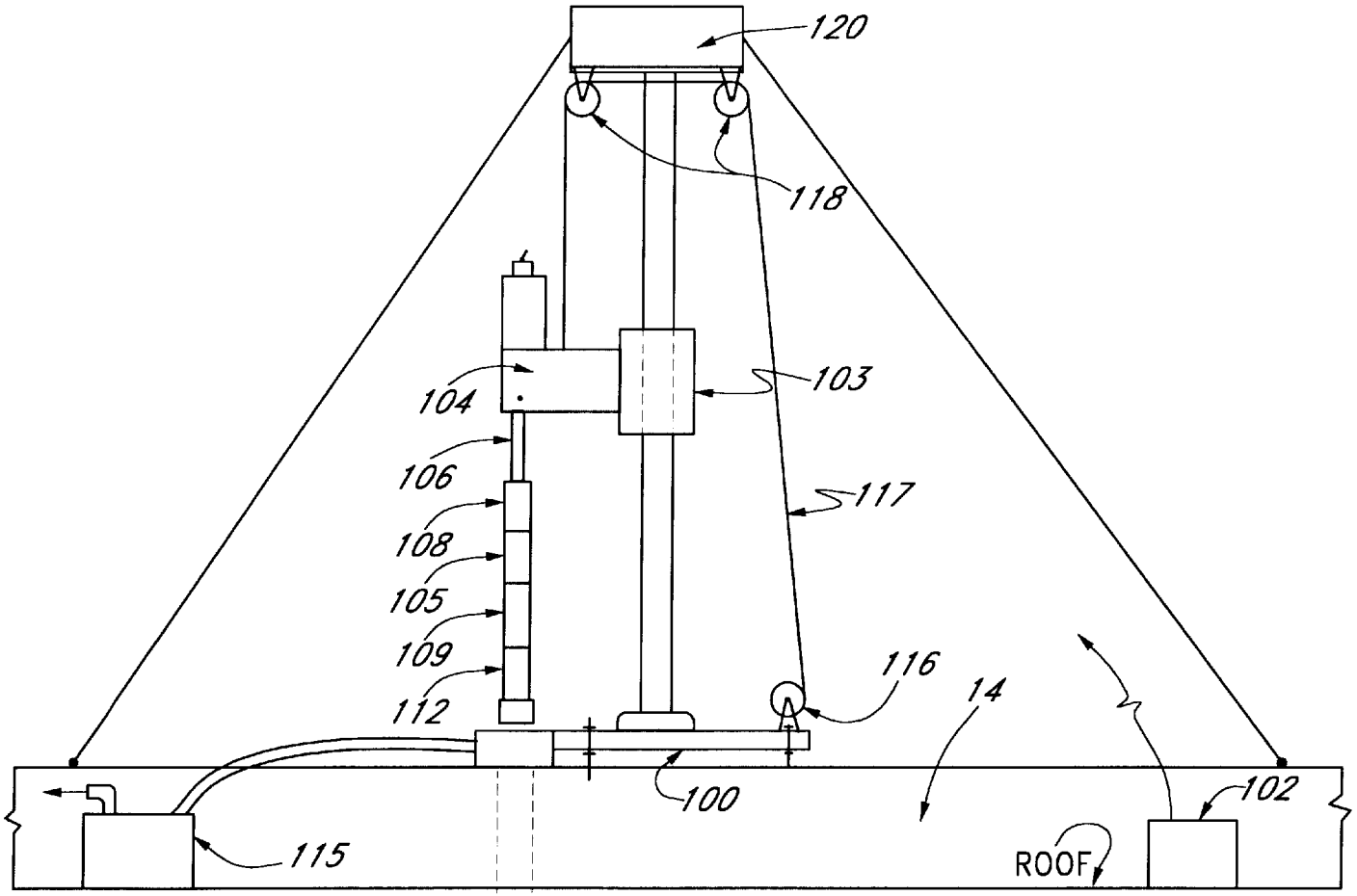
FIG. 4 is a schematic diagram illustrating a first dry core drilling procedure for forming the bores in the masonry wall structure.
Figure 5:
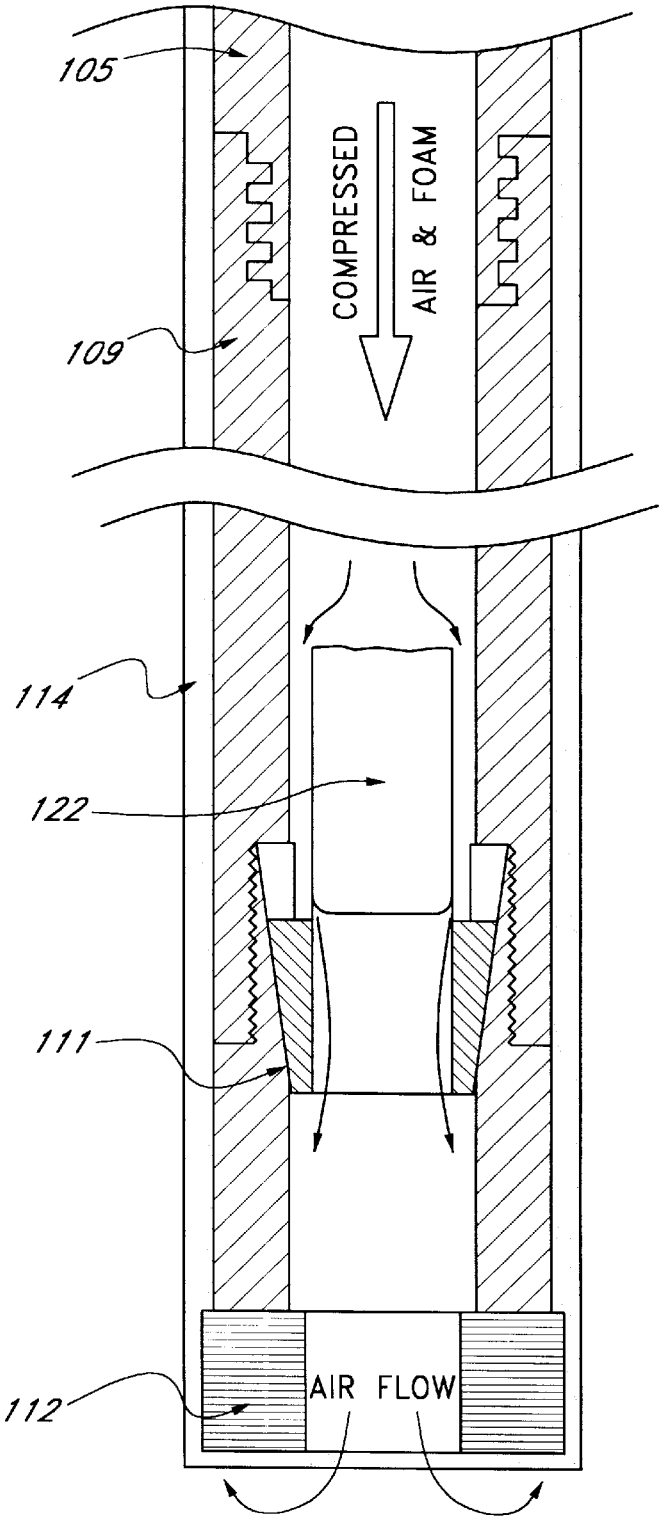
FIG. 5 is an enlarged detailed view in section illustrating formation of the bore.

For dry core drilling, two basic methods are employed, both of which are generally known and practiced in the drilling industry. For small diameter holes (up to about 3 inches in diameter), exploratory mining type equipment is utilized. For large diameter holes (holes having a diameter of about 3 inches or more), reverse air drilling techniques are employed. FIGS. 4 and 5 illustrate the small diameter core drilling process. As seen in these figures, a drilling machine base 100 and post 101 are securely anchored to the top of the masonry wall structure 14 to be drilled. A suitable power source 102 (air or electric or hydraulic) is provided. Next, a drill carriage 103 and an hydraulic, air or electric motor 104 having a threaded spindle assembly is attached to the post 101 which is carefully aligned to ensure center line and plumb or desired angular accuracy of the finished hole. Next, an exploratory mining type steel drill casing or drill rod 105 is attached to the threaded core drill motor spindle 106 by means of a threaded adapter coupler 108. Next, a threaded adaptor shell 109 is attached to the drill casing or drill rod 105, and a heat treated alloy steel core lifter (core spring) 111 (see FIG. 5) is inserted in the adapter shell 109. A carbide or diamond core bit 112 is next attached to the adaptor shell 109. The core bit 112 also secures the core lifter 111. The core drill motor 104 is then energized at speeds which vary from about 100 to about 800 RPM, and downward pressure is applied to the drill casing or drill rod 105. This begins the drilling process. A foaming agent such as an air drilling foam sold under the various trademarks Drillfoam, Quickfoam, Versafoam and Wyofoam, either alone or in combination with compressed air, is pumped down the center of the core drill casing or drill rod 105. This facilitates casing and bit cooling, bit dust evacuation, foam assisted lifting and suppression of drilling dust 114 and casing/rod lubrication. A vacuum or cyclone 115 is used to collect dust and/or foam at the hole entry location.

During drilling, core casing is added, usually in about 5 feet lengths, with the assistance of an electric, hydraulic or air powered cable winch 116 attached to the core drill base 100 with the cable 117 strung across sheaves 118 attached to a short I-beam 120 which straddles the top of the core drill post at an angle of 90 degrees and allows the cable 117 to attach to the core drill motor 104 pulling it and the attached casing 105 up the post 101. Upon completion of the hole drilling or bit replacement, the core drill casing/rod 105 and captured core 122 are removed from the hole.

Figure 6:
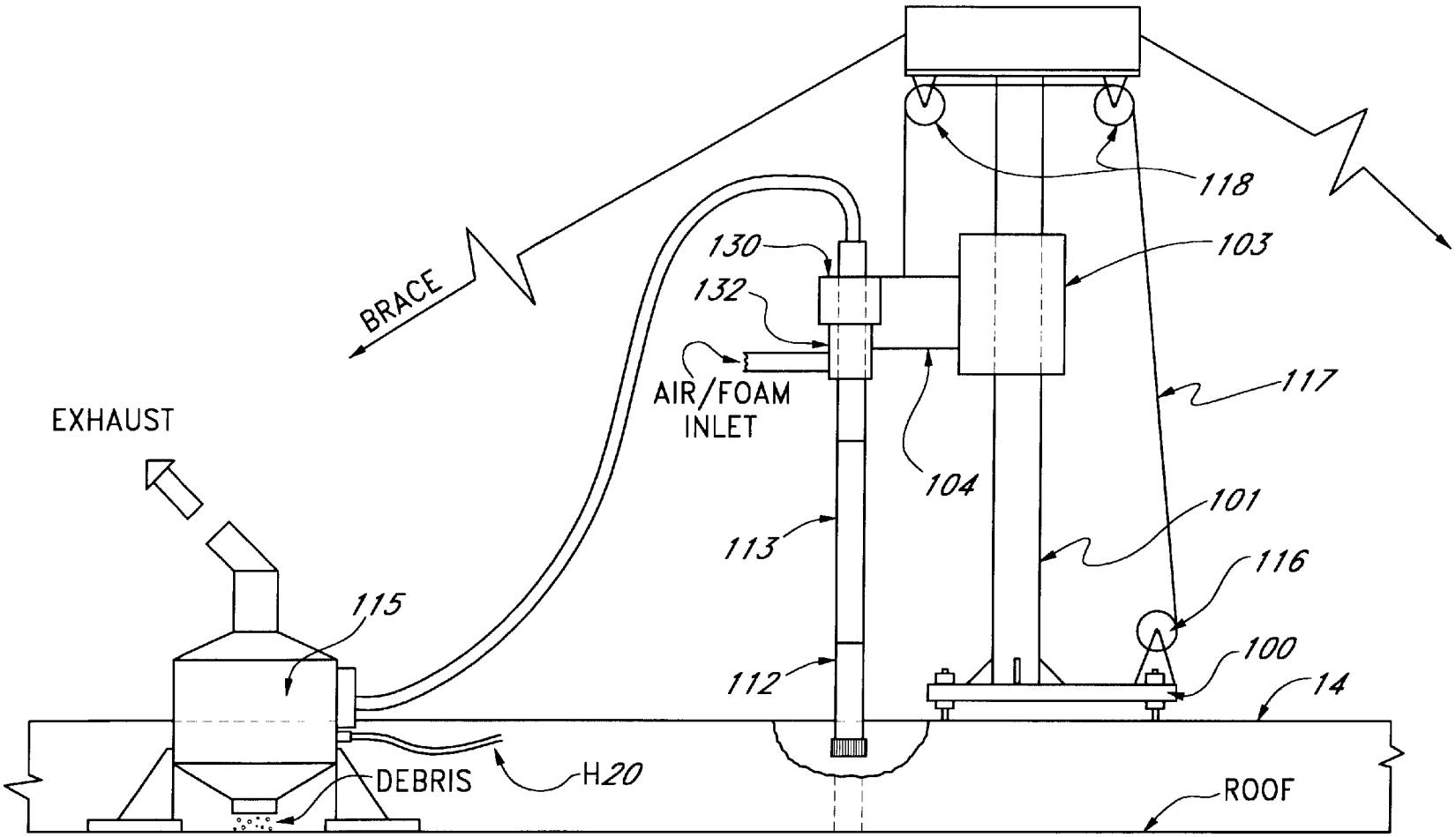
FIG. 6 is a schematic diagram illustrating a second dry core drilling procedure for forming bores in the masonry wall structure.
Figure 7:
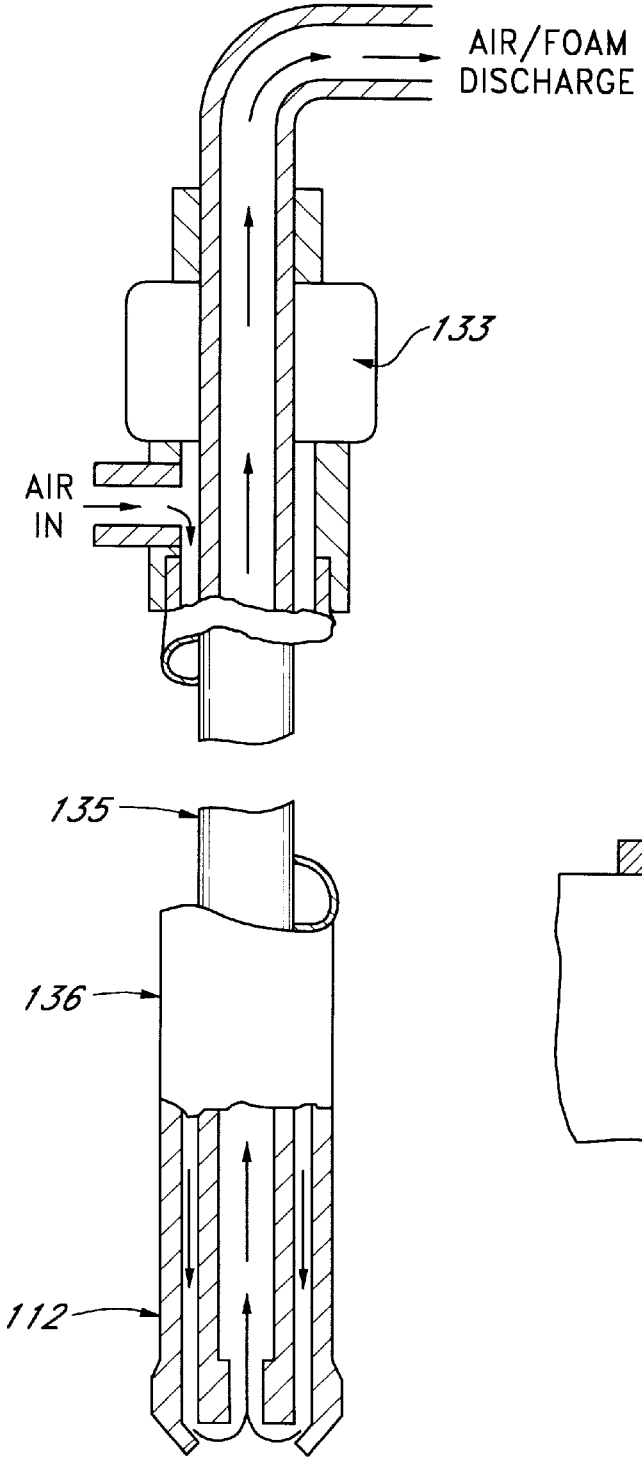
FIG. 7 is an enlarged sectional view illustrating bore formation.

FIGS. 6 and 7 illustrate the reverse air drilling procedure used for larger diameter holes. As seen in these figures, a drilling machine base 100 and post 101 are securely anchored to the masonry wall 14 to be drilled. A drill carriage 103 and an hydraulic, air or electric drive motor 104 with a threaded spindle or chuck assembly 130 is attached to the post and carefully aligned to ensure center line and plumb or the desired angular accuracy of the finished hole. A dual wall reverse circulation rotary drill casing assembly 132 using compressed air as the drilling medium is attached to the core drill motor 104 by means of a threaded adapter or mechanical or hydraulic chuck 133 (see FIG. 7), such as that supplied by Foremost Drill Systems. A carbide or diamond bit 112 is attached to the outer drill string 113. The core drill motor 104 is next energized at a speed in a range from about 100 to about 800 RPMs, and downward pressure is supplied to the drill casing 113. This commences drilling. During drilling, compressed air or an air/foam mixture is forced down the drill string between the inner pipe 135 and the outer pipe 136 to the face of the drill bit 112 with the circulation fluid returning within the inner pipe along with the cutting and core debris. A vacuum or cyclone 115 is used to collect the cutting and core debris at the top of the drill casing 113. Core casing is added, typically in approximately 5 feet lengths, with the assistance of an electric, hydraulic or air cable winch 116 attached to the core drill carriage base 100 with the cable 117 strung across sheaves 118 attached to a short I-beam 120 that straddles the top of the core drill post 101 at an angle of 90 degrees and allows the cable 117 to attach to the core drill motor 104 pulling it and the attached casing 113 up the post 101. Upon completion of the hole, or during bit replacement, the double casings are removed from the hole.

After formation of the holes in the masonry wall 14, the holes are thoroughly cleaned of any residual dust and debris, typically by brushing the sides of the hole with a bottle brush and applying a vacuum to remove the loosened dust and debris. Special attention is given to the bottom portion of the hole (e.g. the bottom 5 feet) where the majority of the debris accumulates during drilling and where the rods are anchored.

To install a connector column 12, a section of foam rod having an outer diameter slightly smaller than the inner diameter of the hole is lowered into the hole to a point just below the desired location of the lowermost connector assembly 20. At this location, void 35 (FIG. 2) is formed using appropriate masonry techniques, e.g. by removing one or more bricks, typically using the services of skilled masons. In addition, a section of the flooring is removed and additional framing is installed, if necessary, in order to strengthen the floor diaphragm for the structural connection to the connector assembly 20. The foam rod noted above effectively prevents debris caused by formation of the void 35 in the masonry wall 14 from falling into the cored hole. Once formation of the void 35 has been completed, the foam rod is removed to allow free passage for the post tensioning rods 22.

Installation of the connector assemblies 20 is performed from the bottom to the top of the wall 14. The first section of the rod string is lowered to the bottom of the hole from the parapet of the building structure. Centering devices may be optionally attached to the rods in order to maintain the centroid of the section when walls later deflect under the imposition of external forces. A suitable adhesive, such as any one of a number of resin based or cementitious fluids, is then tremmied to the bottom of the hole in order to anchor the lowermost rod 22 into the foundation 18. At the first void 35 and then vertically at each specified level throughout the column 12, the connector assemblies 20 are installed as follows.

Foam sleeve 60 (see FIG. 2) is placed over the lower rod 51 and inserted into a portion of hole 61 at the bottom of void 35. Foam sleeve 60 extends to the intended location of the underside of lower bearing plate 37. Bearing plate 37 is then installed over lower rod 51 and flange 41 is next secured to the floor 16. Next, the lower portion of void 35 is filled with a high strength pourable grout, which is then permitted to harden. After hardening of the grout, the grout pocket separator 65 is adhered to the top surface of lower bearing plate 37. Next, connector member 40 is installed over the upper end of rod 51, after which the top bearing plate 44, coupler nut 52 and the lower threaded end of upper rod 55 are assembled. Foam sleeve 62 is next installed about coupler nut 52 and upper rod 55 and inserted into upper hole 63. This permits unimpeded vertical movement for coupler nut 52 during tensioning of the rods (described below), as well as free horizontal motion when the wall 14 and floor 16 experience external forces. Next, the upper portion of void 35 is filled with the high strength pourable grout, which is permitted to harden. If desired, dowel holes may be formed in the adjacent masonry wall structure, and dowels may be anchored in these holes prior to filling the upper or lower portions of void 35 with the grout. This provides an additional support connection between the hardened grout and the adjacent masonry wall structure.

Figure 8:
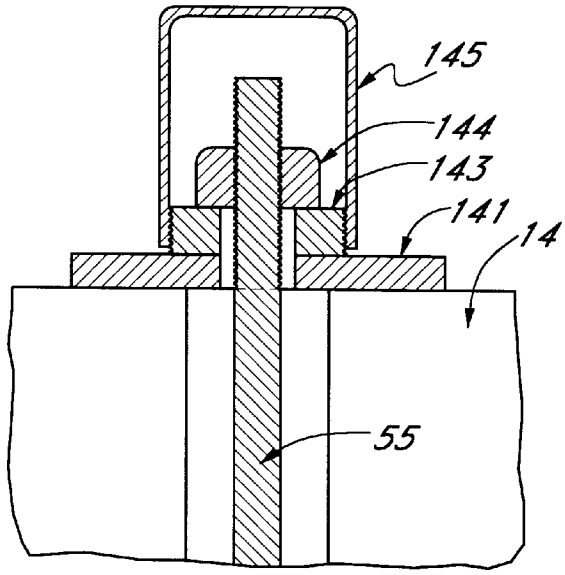
FIG. 8 is a enlarged sectional view showing the top end of the uppermost rod in a single column.

When the uppermost connector assembly 20 has been installed and the upper rod 55 is in place, the upper end of upper rod 55 protrudes through the top of the wall 14. With reference to FIG. 8, a bearing plate 141 is attached to the upper surface of the masonry wall structure 14. A bearing washer 143 and tensioning nut 144 are installed to the top end of upper rod 55, and the string of interconnected rods extending from the building foundation 18 to the top is tensioned to a desired value using conventional tools. After tensioning, a weather proof cover 145 is removably installed over the end of rod 55, and elements 143 and 144.

During installation of the intermediate spring tensioned connector assemblies 30, the springs 70 are tensioned in accordance with the design specifications for the structural wall 14 by adjusting nut 74 using conventional tools and procedures. As noted above, installation of the connector assemblies 30 is essentially identical to the procedures used for installing connector assemblies 20, with the exception that there are no cored holes to contend with. Consequently, neither the foam rod nor the foam sleeves 60, 62 are required.

The invention may be used for structural retrofitting of existing masonry buildings as well as for strengthening new masonry buildings. As will now be apparent, the system is unobtrusive and particularly useful for retrofitting existing historic structures. When used in a retrofitting application, the process begins with an accurate survey and evaluation of existing building conditions and the existing materials in order to ascertain structural values and attributes for design analysis. The retrofitting design is largely based upon the unique effects generated by the combination of the tensioned steel rods and the connector assemblies 20, 30. The tensioning is controlled to provide a specific axial compressive load to the wall. This makes the wall more ductile and resistant to in-plane and out-of-plane bending. In addition, the tensioning provides additional shear resistance at the mortar joints. Connector assemblies 20, 30 provide lateral resistance to shear forces at the wall to floor intersection and also function to absorb or dampen externally applied forces by converting lateral movement to vertical movement.

As noted above, in many existing masonry structures, the mortar used to adhere together the individual masonry blocks has deteriorated due to weathering, aging and other factors. Consequently, the mortar has lost adhesive strength, becomes soft and friable, which weakens the adhesive bond between the individual masonry elements. In such cases, the following additional strengthening procedure is employed, for which the term "STITCH-A-WALL" has been coined.

Figure 9:
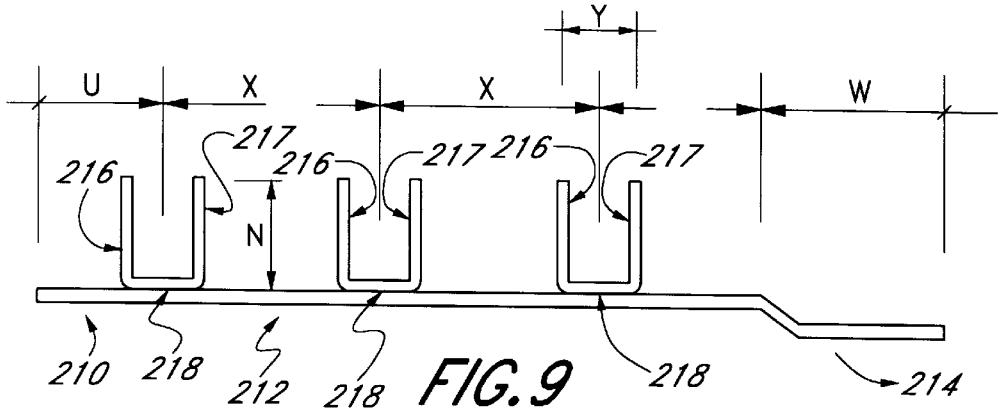
FIG. 9 is top plan view of a preferred embodiment of a single reinforcing member according to the invention.

FIG. 9 is a top plan view illustrating a preferred embodiment of a single reinforcing member fabricated according to the teachings of the invention. As seen in this figure, a reinforcing member generally designated with reference numeral 210 has an elongate main body portion 212 and an offset end section 214 extending substantially parallel to the elongate body portion 212 but offset from the axis thereof by a small amount.

Secured along elongate body portion 212 are a plurality of U-shaped leg members each having first and second leg portions 216, 217 and an interconnecting bight 218. Leg portions 216, 217 extend away from the axis of elongate body member 212 preferably in parallel directions normal to the axis of elongate body portion 212. The U-shaped leg members and the elongate body portion 212 and offset end section 214 are preferably fabricated from a suitable strengthening material, such as 3/16ths inch cold drawn steel wire. The leg members are secured to the elongate body portion 212 by any secure bonding technique, such as welding.

The leg sections are spaced along the elongate body portion 212 at predetermined intervals X. In one specific example, the center to center distance X is set at 2 feet 8 inches between the leg sections; the leftmost leg section is positioned 1 foot 8 inches from the left end of elongate body portion 212 (dimension U in FIG. 9); and the rightmost leg section is spaced 1 foot 0 inch from the beginning of the offset end section 214 (dimension V in FIG. 9). The length of the offset end section 214 is 1 foot 0 inch (dimension W in FIG. 9) so as to provide uniform spacing between the leg sections when a plurality of reinforcing members 210 are installed in the manner described below.

Figure 10:
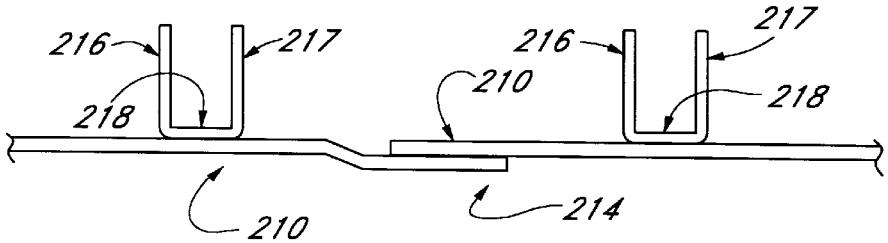
FIG. 10 is a top plan partial view of two reinforcing members illustrating the lap joint therebetween.

With reference to FIG. 10, when two reinforcing members 210 are arranged in situ, the offset end section 214 mates with the straight end section of an adjacent reinforcing member 210 to form a lap joint therebetween. This configuration ensures mutual physical contact between reinforcing members 210, which enhances the transfer of forces traveling along the axis of one reinforcing member 210 to the next reinforcing member 210.

Figure 11:
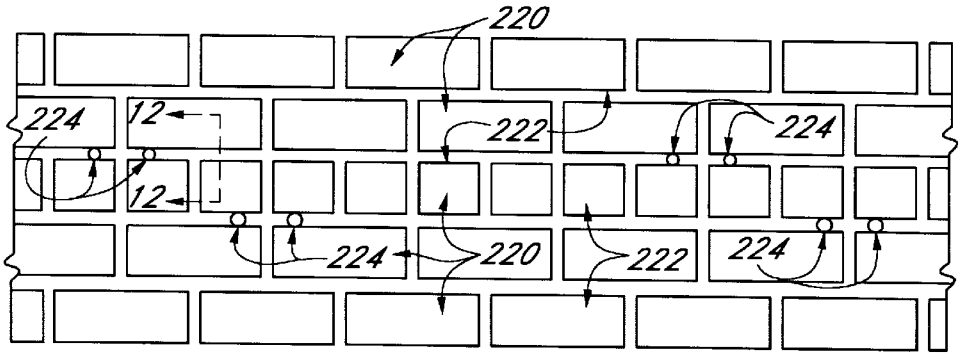
FIG. 11 is a partial elevational view of a masonry structure illustrating the bore hole locations.

FIG. 11 illustrates a masonry structure prepared for the installation of a plurality of reinforcing members 210 for the purpose of reinforcing that masonry structure. As seen in this figure, a plurality of masonry elements 220, such as bricks or cement blocks, are arrayed in the usual row and column fashion and bonded together by means of an adhesive material, such as cementitious mortar 222. The masonry structure is initially prepared by removing the original adhesive material 222 to a desired depth along the horizontal rows. Thereafter, a plurality of bore holes 224 are formed at spacings corresponding to the locations of the leg portions 216, 217 of reinforcing members 210. The length of each bore hole 224 is accurately drilled to match the length of the leg portions 216, 217 (dimension Z in FIG. 9). The bore holes 224 may be drilled using an appropriate template or drill guide (not shown) to facilitate the spacing and depth of the bore holes 224.

After formation of the bore holes 224, an adhesive substance, preferably a non-sagging epoxy adhesive, is injected into the bore holes 224 in premeasured amounts. Next, the leg portions 216, 217 of the reinforcing members 210 are inserted into the associated bore holes 224 and tapped into place so that adjacent reinforcing members 210 form lap joints at their engaging ends. Thereafter, an adhesive substance, such as non-sagging epoxy, is applied over the reinforcing members 210 in the voids between vertically adjacent masonry elements 220, and this adhesive substance is tooled in order to bond the reinforcing members 210 to the masonry elements 220, the remaining portions of the original mortar 222 and each other. After the adhesive substance has set up, the installation may be finished with a mortar having a color and texture which matches that of the original mortar.

Figure 12:
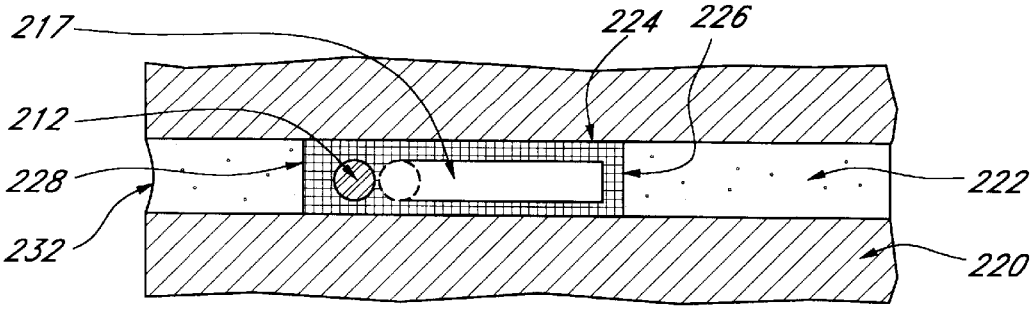
FIG. 12 is an enlarged sectional view taken along lines12—12 of FIG. 11 illustrating the leg portion of a reinforcing member installed in a bore hole.

FIG. 12 is an enlarged sectional view taken along lines 12—12 of FIG. 11 showing a single leg portion 217 of a reinforcing member 210 bonded into an associated bore hole 224. As can be seen in this figure, leg portion 217 is embedded in the first adhesive substance 226 which was injected into bore hole 224 prior to insertion of the leg portion 217. Elongate body portion 212 is also covered by the second applied adhesive substance 228. The finishing mortar 232 fills the joint between adjacent blocks 220 from the outer surface of the adhesive substance 228 to the front wall surface of blocks 220. The original mortar 222 remains in the interior of the joint behind the inner end of leg portion 217.

It should be noted that the invention may be applied to either the external wall surface of the masonry structure, the internal wall surface of the masonry structure, or both. Further, in some cases it may not be necessary to use the final finish mortar 232 (for example, when refinishing from the interior wall surface knowing that other interior finishing will be done after the reinforcement procedure—such as adding decorative panels). Also, if desired the reinforcing members 210 may be installed in an attitude other than the horizontal attitude described and depicted (e.g. at a vertical attitude), although the horizontal arrangement is preferred at this time.

As will now be apparent, the invention provides a substantial and appropriate strengthening to both new and existing masonry structures which improves the performance of such structures in response to externally imposed forces, such as those due to earthquakes, high winds, vibrations and the like. This strengthening is achieved by means of the post-tensioned vertically arranged rod and connector assemblies, in combination with the independent spring-tensioned connector assemblies mounted in those locations in which core formation is impossible or impractical. Further, the strengthening is achieved without altering the appearance of existing structures or the desired masonry-finish appearance of new structures.

Also, the STITCH-A-WALL aspect of the invention affords a relatively inexpensive masonry element reinforcing technique applicable to both existing masonry structures and new masonry structures under construction, which is relatively inexpensive to install and highly effective in providing additional strength—particularly shear strength—to masonry structures. In addition, the reinforcement technique can be installed in such a manner as to not be visible, which is highly desirable when performing seismic retrofitting for buildings of historical significance.

While the above provides a full and complete disclosure of the preferred embodiments of the invention, various modifications, alternate constructions and equivalents will occur to those skilled in the art. For example, while the tensioning rod and spring-tensioned aspects of the invention have been described with reference to particular core drilling equipment and supplies, other types of core drilling equipment and supplies may be employed. Also, in cases where the interior of the wall structure has deteriorated, the cored hole may itself be grouted for structural continuity either prior to or after installation of the steel rods. In such a case, the steel rods should be physically isolated from the grout with a suitable covering (such as a foam sleeve) so that post-tensioning of the rods is not impaired. Further, in building locations in which tensioning rods cannot be installed completely from the building parapet down to the foundation, the rods may be terminated at an upper floor by anchoring the rod to the diaphragm of the selected floor. Also, while the reinforcing members have been described and illustrated in FIGS. 9 and 10 as having an offset end section with a circular cross-sectional shape, other configurations may be employed. For example, the offset end section may have a flattened profile and the other end may have a similarly flattened mating profile. Also, the offset end section may be formed with a concave mating surface profile shaped to receive the other end of an adjacent reinforcing member to provide a nesting fit. Also, reinforcing members having a single leg portion (rather than U-shaped) or three or more leg portions may be employed, if desired. Therefore, the above should not be construed as limiting the invention, which is defined by the appended claims.

What is claimed is:

1. A method of strengthening a masonry wall structure having a top and a bottom and at least one floor intermediate the top and bottom, said method comprising the steps of:

(a) forming a plurality of bores generally extending between the top of the wall structure and a lower portion of the wall structure;

(b) installing a plurality of series-connected rods and a plurality of force transmission connectors into each bore with the force transmission connectors positioned generally at the floor level, each force transmission connector having a first portion coupled to the associated floor and a second portion coupled to the adjacent wall structure;

(c) installing a plurality of spring-tension connectors generally at the floor level in regions of the wall structure between the bores, each spring-tension connector having a first portion coupled to the associated floor and a second portion coupled to the adjacent wall structure; and (d) tensioning the rods and the spring-tension connectors to a desired force level to provide compressive forces between the top of the wall structure and the lower portion of the wall structure through the rods and the force transmission connectors and force dampening in the spring-tension connector regions of the wall structure.

2. The method of claim 1 wherein said step (a) of forming includes the step of dry core drilling from the top to the bottom of the wall structure.

3. The method of claim 2 wherein said step (a) of forming includes the step of providing a vacuum in each bore during drilling to remove dust and debris.

4. The method of claim 2 wherein said step (a) of forming includes the step of providing a positive fluid pressure into each bore during drilling to assist in the removal of dirt and debris.

5. The method of claim 1 wherein said step (b) of installing includes the step of forming a void in the masonry wall structure at the location of each force transmission connector.

6. The method of claim 1 wherein said step (c) of installing includes the step of forming a void in the masonry wall structure at the location of each spring-tension connector.

7. The method of claim 1 wherein steps (b) and (c) of installing further include the steps of forming a void in the masonry wall structure at the location of each force transmission connector and each spring-tension connector, substantially filling a lower portion of each void with a hardenable liquid, permitting the liquid to harden, isolating the hardened liquid from the upper portion of each void, substantially filling the upper portion of each void with a hardenable liquid, and permitting the liquid to harden.

8. The method of claim 1 wherein the masonry wall structure has a plurality of floors; and wherein said step (b) of installing is performed progressively from the lowermost floor to the uppermost floor.

9. The method of claim 1 wherein said step (a) of forming is performed between the top and the bottom of the wall structure.

10. The method of claim 1 further including the step of applying a hardenable liquid to at least a portion of at least one of the bores to provide an apertured reinforcing bore surface.

11. A system for reinforcing a masonry wall structure having a top, a bottom, and at least one floor intermediate the top and bottom, said system comprising:

a plurality of bores formed in the masonry wall structure between the top and a lower portion of the masonry wall structure;

a plurality of series-connected post-tensioned rods and force transmission connectors located in each of said bores with the force transmission connectors located generally at the level of said at least one floor, said force transmission connectors each including a first portion coupled to the associated floor and a second portion coupled to the adjacent masonry wall structure; and a plurality of spring-tension connectors located in regions of the wall structure between the bores at the level of said at least one floor, said spring-tension connectors including a first portion coupled to the associated floor, a second portion coupled to the associated masonry wall structure, and a tensioned spring means coupled between the first and second portions to dampen relative motion therebetween.

12. The system of claim 11 further including a plurality of voids formed in the masonry wall structure at the location of said plurality of force transmission connectors and said spring tension connectors, each void containing an associated one of said connectors and having a first mass of hardened material in a lower void portion, a second mass of hardened material in an upper void portion, and a void separator located between the first and second masses.

13. The system of claim 11 wherein the first and second portions of each force transmission connector include a tapered wall portion; and wherein each force transmission connector includes a connector member having a pair of tapered wall sections each received in a different one of said tapered wall portions of said first and second portions and a central through-bore for slidably receiving an associated one of said rods.

14. The system of claim 13 wherein at least one of said tapered wall portions is coated with a low-friction material.

15. The system of claim 11, wherein the first and second portions of each spring-tension connector includes a tapered wall portion; and wherein each spring-tension connector includes a connector member having a pair of tapered wall sections each received in a different one of said tapered wall portions of said first and second portions and a central through-bore, and a fastener passing through said central through-bore for coupling said tension spring means to said first and second portions.

16. The system of claim 11 wherein at least some of said bores extend between the top and the bottom of the masonry wall structure.

17. The system of claim 11 further including a mass of hardened material adhered to at least a portion of at least one of said plurality of bores to provide an apertured reinforcing bore surface.

18. A method of strengthening a masonry wall structure having a top and a bottom and at least one floor interposed between the top and the bottom, said method comprising forming a generally vertically extending bore within the wall, positioning an axially moveable rod within said bore, positioning a lower portion of a force transmission coupling within the wall at a location generally defined by the floor and said bore, securing said lower portion of said force transmission coupling within the wall, positioning a load transmission member and an upper portion of said force transmission coupling within the wall over said lower portion, positioning an additional axially moveable rod within said bore, connecting said additional rod to said rod, securing said upper portion of said force transmission coupling within the wall and placing said connected rods under a compressive force such that the wall is prestressed under a compressive load.

19. The method of claim 18, wherein said upper and lower portions of said force transmission couplings are secured in position with an upper pocket of hardenable material and a lower pocket of hardenable material respectively.

20. The method of claim 19, wherein said lower pocket of hardenable material is separated from said upper pocket of hardenable material such that said upper pocket and said lower pocket are capable of relative movement.

21. The method of claim 18, wherein at least two bores are formed within the wall and at least one spring-tension connector is interposed between two of said at least two bores.

22. The method of claim 18, wherein said load transmission member and at least one of said upper portion and said lower portion interact along an inclined surface such that lateral motion of said at least one of said upper portion and said lower portion translates into a force directed upward or downward in the wall or said rods.

23. A method of strengthening a masonry wall structure having an internal defect therein, said method comprising beginning to drill a generally vertical bore through the wall and into the internal defect in the wall, injecting a hardenable material into the internal defect through said bore, allowing said hardenable material to at least substantially cure, and continuing to drill said bore through said hardenable material and the wall whereby a strengthening column may be inserted into the wall for strengthening the wall.

24. The method of claim 23, wherein the strengthening column comprises a post-tensioned rod.

25. The method of claim 23, wherein the hardenable material is injected into the internal defect through an additional hole drilled into the internal defect.

26. The method of claim 23, wherein the hardenable material is injected into the internal defect through the generally vertically extending bore.

27. The method of claim 23, wherein the hardenable material is injected prior to the strengthening column being inserted into the bore.

28. A system for reinforcing a masonry wall structure having a top, a bottom, and at least one floor interposed between the top and the bottom, said system comprising a pocket formed in the wall proximate the floor, a spring-tension connector inserted into the wall, said spring-tension connector comprising a first portion connected to the floor, a second portion connected to the wall, an intermediate member positioned between said first portion and said second portion, a first interface defined between said first portion and said intermediate member and a second interface defined between said second portion and said intermediate member, at least one of said first interface and said second interface having an inclined surface relative to the floor, a spring-tensioned member holding said intermediate member in position between said first portion and said second portion such that any lateral motion of the floor is transferred through at least one of said first interface and said second interface into the spring-tensioned member.

29. The system of claim 28, wherein said first portion is connected to the wall with a first pocket of hardenable material.

30. The system of claim 29, wherein said second portion is connected to the wall with a second pocket of hardenable material.

31. The system of claim 30, wherein said first pocket and said second pocket are separated from one another such that they may move relative to one another.

32. A system for reinforcing a masonry wall structure having a top, a bottom, and at least one floor interposed between the top and the bottom, said system comprising a pocket formed in the wall proximate the floor, a bore extending through the wall in a direction generally normal to the floor, a connector inserted into the wall, said connector comprising a first portion secured to the floor, a second portion secured to the wall, an intermediate member positioned between said first portion and said second portion, a first interface defined between said first portion and said intermediate member and a second interface defined between said second portion and said intermediate member, at least one of said first interface and said second interface having an inclined surface relative to the floor, a rod extending longitudinally within said bore, said rod passing through said first portion, said intermediate member, and said second portion, said rod receiving a compressive load, said rod holding said intermediate member in position between said first portion and said second portion such that lateral motion of the floor may be transferred through at least one of said first interface and said second interface into at least one of the wall or said rod.

33. The system of claim 32, wherein said first portion is connected to the wall with a first pocket of hardenable material.

34. The system of claim 33, wherein said second portion is connected to the wall with a second pocket of hardenable material.

35. The system of claim 34, wherein said first pocket and said second pocket are separated from one another such that they may move relative to one another.

* * * * *